US005717292A

United States Patent [19]

Jin et al.

[11] Patent Number: 5,717,292

[45] Date of Patent: Feb. 10, 1998

[54] PLASMA DISPLAYS EMPLOYING MAGNETIC ENHANCEMENT

[75] Inventors: Sungho Jin, Millington; Gregory Peter Kochanski, Dunellen; Wei Zhu, Middlesex, all of N.J.

[73] Assignee: Lucent Technologies Inc., Murray Hill, N.J.

[21] Appl. No.: 565,739

[22] Filed: Nov. 30, 1995

[51] Int. Cl.[6] ..... H01J 17/89

[52] U.S. Cl. ..... 313/582; 313/584; 313/156; 313/160; 313/161

[58] Field of Search ..... 313/153, 154, 313/156, 160, 161, 582, 584, 586, 587

[56] References Cited

U.S. PATENT DOCUMENTS

| | | | |
|---|---|---|---|
| 3,706,912 | 12/1972 | Ikegami | 313/584 |
| 4,417,172 | 11/1983 | Touhou et al. | 313/156 |
| 4,443,734 | 4/1984 | Gross et al. | 313/161 |

OTHER PUBLICATIONS

H.G. Slottow, "Plasma Displays", *IEEE Trans. Electron Devices,* vol. ED–3, No. 7, p. 760–772 (1976).

S. Mikoshiba, "Plasma Displays", *Society for Information Display,* Seminar No. F–2, pp. F–2/3–F2/31 (1993).

*Primary Examiner*—Nimeshkumar Patel

*Attorney, Agent, or Firm*—Glen E. Books; Bruce S. Schneider

[57] ABSTRACT

Improved plasma displays utilize permanent magnet components for low-voltage operation. Permanent magnet components providing magnetic fields transverse to the direction of electron movement increase the electron pathlength, thereby enhancing the ionization efficiency of the electrons. This permits lower voltage operation, higher-pixel density and greater durability. In exemplary embodiments, magnetic components can be placed below the cathode, disposed between the electrodes, or incorporated in the cathode.

6 Claims, 3 Drawing Sheets

PLASMA DISPLAYS EMPLOYING MAGNETIC ENHANCEMENT

FIELD OF THE INVENTION

This invention pertains to plasma displays including permanent magnetic components for permitting operation at reduced voltages.

BACKGROUND OF THE INVENTION

Plasma displays utilize emissions from regions of low pressure gas plasma to provide visible display elements. A typical display cell comprises a pair of electrodes within a sealed cell containing a noble gas. When a sufficient voltage is applied between the electrodes, the gas ionizes, forms a plasma, and emits visible and ultraviolet light. Visible emissions from the plasma can be seen directly. Ultraviolet emissions can be used to excite visible light from phosphors.

A plasma panel display is an addressable array of such display cells. Typically plasma panel displays are fabricated as an array of cells defined by two mating sets of orthogonal electrodes deposited on two respective glass substrates. The region between the substrates is filled with a noble gas, such as neon, and sealed.

Plasma displays have found widespread applications ranging in size from small numeric indicators to large graphics displays. Typical applications are described in H. G. Slottow, *IEEE Trans. Electron Devices,* Vol. ED-23, No. 7, p. 760 et seq (1976) and S. Mikoshiba, *Society for Information Display,* Seminar No. F-2 (1993) which are incorporated herein by reference. Plasma displays are strong contenders for future workstation displays and HDTV displays.

The commercial success of plasma displays is due to many desirable properties. For example, a plasma has very strong nonlinear current-voltage characteristic which is ideally suited for multiplexing or matrix addressing. This nonlinearity also provides internal memory and logic capabilities which can be used to reduce the number of external circuit drivers. The ultraviolet radiation from a plasma can be used to excite phosphors, thereby permitting fabrication of full color displays. Other favorable attributes of plasma displays include long lifetime (~10,000 hrs for dc displays and >50,000 hrs for ac displays) with no catastrophic failure mechanism. They provide high resolution, good contrast ratio, a wide viewing angle (comparable to a CRT), and gray scale capability (8-bit, 256 levels). The displays are rugged, self-supporting structures which can be made in large areas (a display as large as 1.5 m diagonal with 2,048×2,048 pixels has been reported), and they are tolerant to harsh environment and wide temperature variations. The principal drawbacks of plasma displays are their high driver voltage (150–200 V), relatively low luminance (~100 cd/m$^2$ compared to 700 cd/m$^2$ for a CRT) and low luminous efficiency (0.2 lm/W compared to 4 lm/W for a CRT).

Plasma displays are usually classified as dc or ac. In a dc display, the electrodes are in direct contact with the plasma. The current is limited by resistance. In an ac display the electrodes are typically separated from the plasma by a dielectric, and the current is limited by capacitance.

DC displays ultimately fail because the cathode material is gradually sputtered or eroded away under the bombardment of positively charged energetic ions from the plasma. Erosion or sputtering of these cathode materials limits the typical lifetime of a de plasma display at ~10,000 hours. The sputtering also leads to the deposit of cathode material on the inner surface of the enclosing glass envelope, reducing the transmission of light.

Addition of small amounts of mercury reduces the sputtering problem but does not solve it. Although the addition of mercury in the gas reduces the effect of sputtering by several orders of magnitude, mercury particles tend to condense at the coldest spot. As a result, active regions where sputtering is severe have less mercury. Mercury is also chemically reactive with metals such as Ba and Ag which are used as electrode or electric lead materials. In addition, the strong visible emission from mercury degrades the color purity.

AC displays using conventional materials are subject to problems of contamination. In a typical ac plasma display the conductive electrode is covered by a dielectric layer which is, in turn, overcoated with MgO. The MgO overcoating has a high secondary electron emission coefficient which reduces the breakdown voltage for the gas. In addition, MgO is resistant to sputtering and thus gives the device a very long lifetime. The problem is that MgO is susceptible to contamination in the manufacturing process. Once contaminated, it is virtually impossible to clean.

The high operating voltage (150–200 V) in conventional plasma displays is disadvantageous. The use of relatively high operating voltages and associated problems in dielectric breakdown make it necessary to use tall dielectric barrier ribs between the cathode and the anode. Since much of the energy loss in the plasma displays is due to the collision of the plasma with the barrier ribs, high aspect ratio display cells with large surface to volume ratios are not desirable. In addition, higher pixel-density displays with smaller cell sizes are difficult to obtain if the barrier rib is to stay tall.

If the operating voltage can be lowered, the height of the rib can be reduced and hence smaller cell sizes can be implemented. Shorter ribs would increase the solid angle subtended by the front transparent electrode and reduce the number of photons absorbed by the barrier rib. Thus for a given input power, more photons would exit the display.

Accordingly, there is a need to develop new plasma displays which will permit lower operating voltage.

SUMMARY OF THE INVENTION

Improved plasma displays utilize permanent magnet components for low-voltage operation. Permanent magnet components providing magnetic fields transverse to the direction of electron movement increase the electron pathlength, thereby enhancing the ionization efficiency of the electrons. This permits lower voltage operation, higher-pixel density and greater durability. In exemplary embodiments, magnetic components can be placed below the cathode, disposed between the electrodes, or incorporated in the cathode.

BRIEF DESCRIPTION OF THE DRAWINGS

The nature, advantages and various additional features of the invention will appear more fully upon consideration of the illustrative embodiments now to be described in detail in connection with the accompanying drawings. In the drawings.

It is to be understood that the drawings are for purposes of illustrating the concepts of invention and are not to scale.

DETAILED DESCRIPTION

Figure 1:
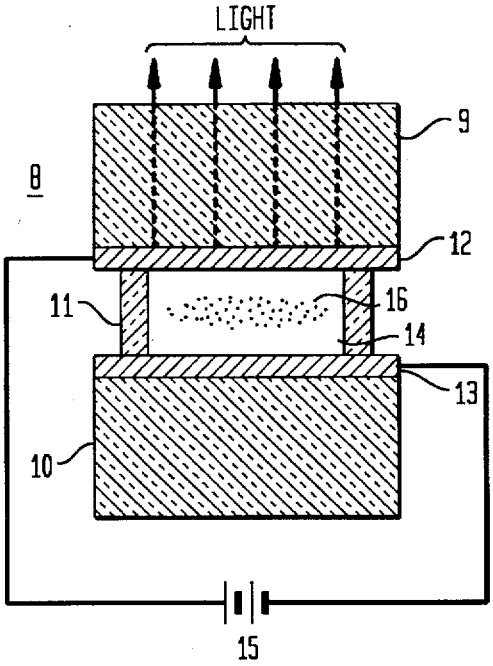
FIG. 1 (PRIOR ART)
FIG. 1 is a cross section of a typical conventional dc plasma display cell.

Referring to the drawings, FIG. 1 is a cross sectional view of a conventional cell 8 for a dc plasma display. The cell 8 comprises a pair of glass plates 9 and 10 separated by barrier ribs 11. One plate 9 includes a transparent anode 12. The other plate 10 includes a cathode 13. The plates 9, 10 are typically soda lime glass. The anode 12 is typically a metal mesh or an indium-tin-oxide (ITO) coating. The cathode 13 is either metal such as Ni, W and stainless steel or a conductive oxide. A noble gas 14 such as neon, argon or xenon (or mixtures thereof) fills the space between the electrodes. The barrier ribs 11 are dielectric, and typically they separate plates 9, 10 by about 200 μm.

In operation, a voltage from a power supply 15 is applied across the electrodes. When the applied voltage is sufficiently high, a plasma 16 forms and emits visible and ultraviolet light which passes through the transparent anode 12 and glass plate 9.

The difficulty with this conventional dc cell can now be readily seen. Since the cathode 13 is immersed in the plasma 16, it is subject to bombardment by energetic ions. At high voltages, the sputtering effect produced by this bombardment severely limits the lifetime of the cathode 13.

Figure 2:
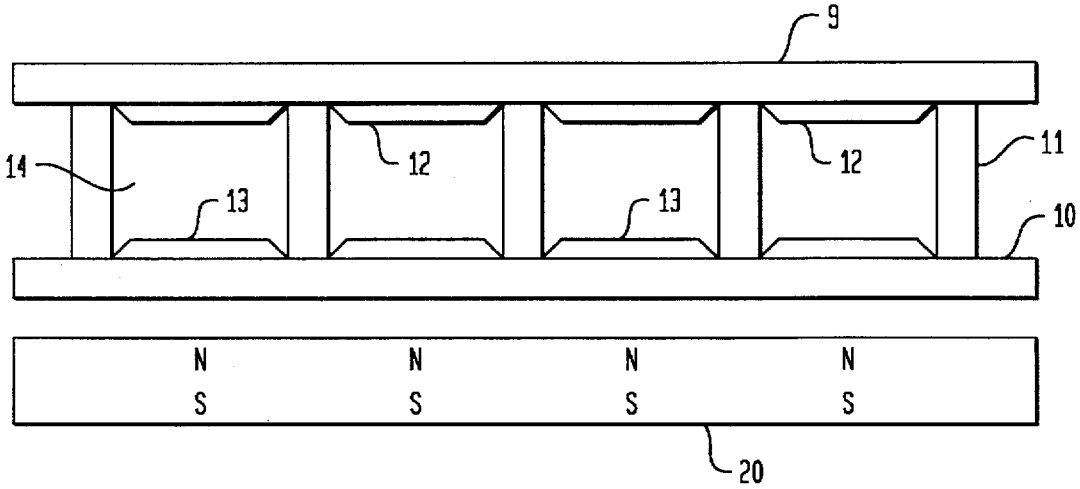
FIGS. 2, 3 and 4 show plasma display cells having magnetic components below the cathodes.

FIG. 2 schematically illustrates improved display cells in accordance with the invention. Each cell of FIG. 2 is similar to that of FIG. 1 except that the cell further comprises a magnetic component 20 beneath the bottom of glass plate 10 (i.e. outside the cell on the cathode side). The magnet 20 can be a flat plate.

Figure 3:
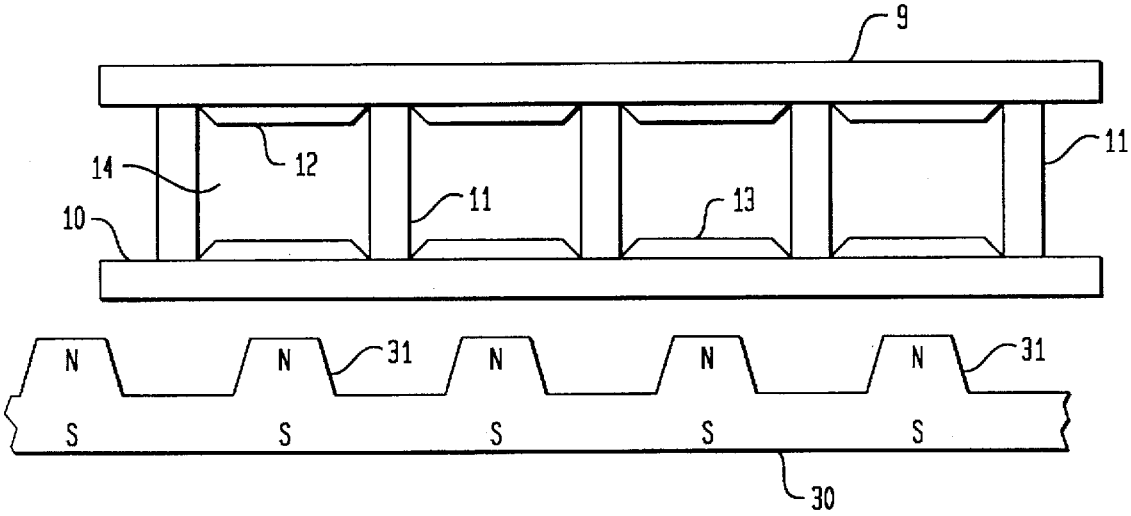

FIG. 3 shows an alternate form of the improved display cell where the magnetic component 30 has a patterned pole structure with magnetic poles 31 in registration with each cell to provide field concentration near each cell.

Figure 4:
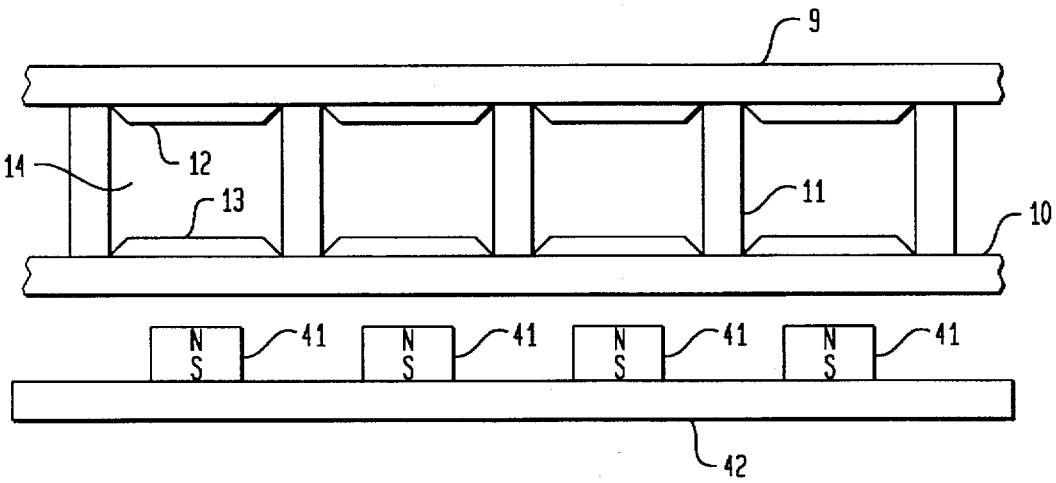

FIG. 4 shows another alternate form where the magnetic component 40 comprises an array of small magnets 41 disposed on a substrate 42 in registration with each plasma display cell.

The effect of these magnetic components in FIGS. 2, 3 and 4 is to increase the ionization efficiency of the available electrons. The addition of the magnetic field to the plasma display cell causes the electrons to take helical paths instead of straight paths, resulting in a longer pathlength, an increased number of collisions with gas atoms, and an increased ionization probability.

In each of the FIGS. 2–4 embodiments, it is desirable that the magnetic component be placed close to the plasma. This means that glass plate 10 is advantageously thinner than conventional plates and is preferably bonded to the magnetic component to enhance its structural integrity.

The material of the magnetic components can be chosen from a number of available alloys or compounds such as Nd—Fe—B, Sm—Co, Alnico, Fe—Cr—Co alloy, Ba-ferrite or Sr-ferrite.

The ideal strength of the magnetic field is sufficiently large that the radii of electron orbits (the cyclotron radius) is small compared to both the pixel size and the mean free path of the electrons. It is thus an increasing function of the gas pressure and a decreasing function of pixel size. For a typical device with 100 μm pixels and 10 Torr gas pressure, the desired field is at least 500 gauss and the preferred field is in the range 2000–5000 gauss.

Figure 5:
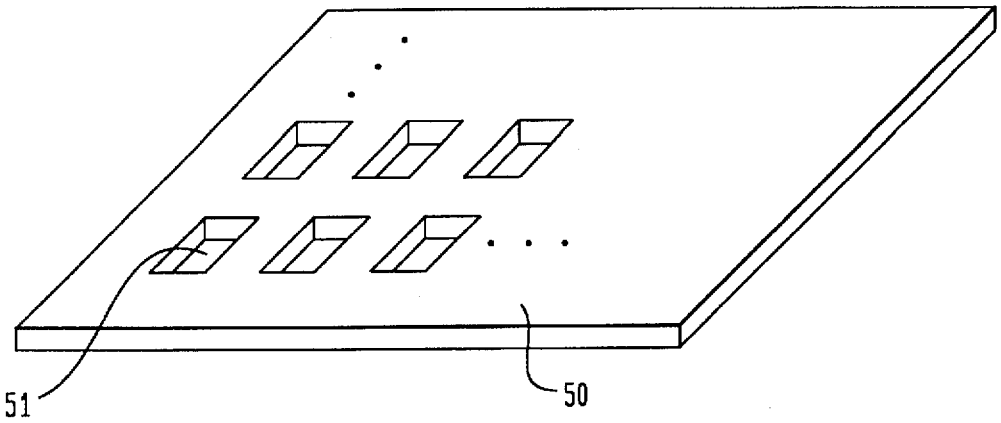
FIG. 5 schematically illustrates a pre-made magnetic barrier rib component for disposition between the electrodes.

The magnetic component can alternatively be disposed between the cathode and the anode of a display. FIG. 5 illustrates a permanent magnet structure comprising a magnetic plate 50 including an array of openings 51 that can be used as a spacer between the electrodes of a display. Each opening 51 corresponds to a display pixel.

The spacer structure can be fabricated in any of a wide variety of ways, including patterned etching, mechanical forming or machining, or screen printing and sintering. It can be made of insulating magnetic material (e.g. hexaferrite material) or conductive magnetic material provided with an insulating layer.

Typical dimensions for a magnetic spacer layer for a plasma display cell is thickness in the range 5–200 μm with a width-to-height aspect ratio of about 0.5–3. Preferably the thickness is 5–25 μm with an aspect ratio of 1–2. The magnetic material advantageously has a coercive force of more than 100 Oe and preferably more than 300 Oe. The material has a remanent induction of at least 100 G and preferably at least 1000 G. Ductile magnets such as Fe—Cr—Co alloys are particularly desirable, as they can easily be rolled into a large area sheet geometry and openings can easily be punched or etched through them.

Figure 6:
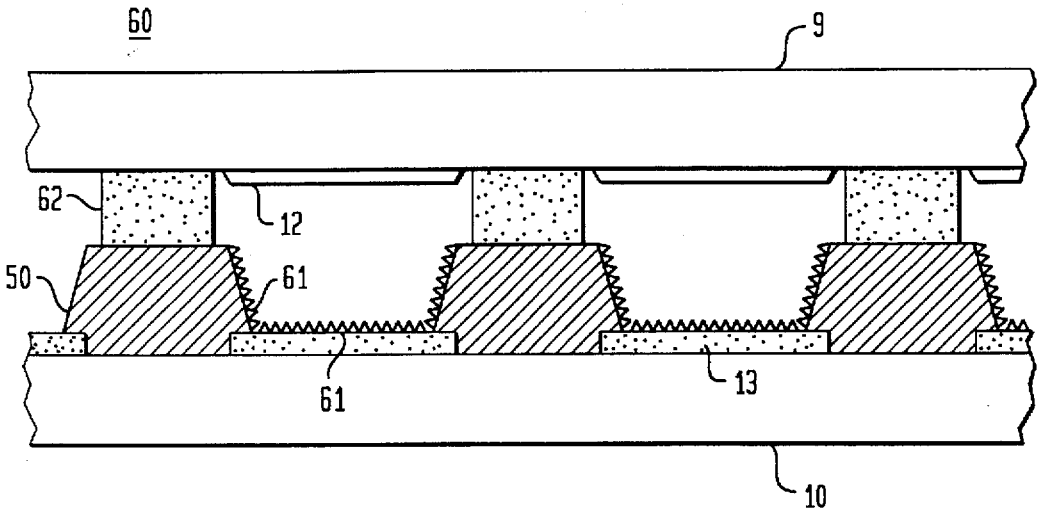
FIG. 6 is a schematic cross section of a plasma display cell using the magnetic barrier rib component of FIG. 5.

FIG. 6 illustrates a display device 60 having a two part wall including a magnetic spacer layer 50 at the bottom side and an electrically insulating barrier wall 62 at the upper side. The substrate 10 can be a glass plate coated with conductive layer stripes 13. The bottom barrier rib screen 50 can be premade of conducting magnetic material as shown in FIG. 5 and dropped onto the stripe-coated substrate 10. Advantageously, a conductive adhesive or solder material (not shown) is applied to the bottom surface of the drop-in magnetic screen 50 for mechanical attachment and improved electrical conduction between the horizontal stripes 13 and the vertical wall of screen 50.

Advantageously a low electron affinity material 61 such as diamond is added to both the stripe 10 and the edges of openings 51 in screen 50. This can be done by applying diamond particles and heat treating in hydrogen plasma at 200°–1000° C.

The next steps in forming the plasma display of FIG. 6 is to add electrically insulating upper barrier ribs 62 on top of the magnetic screen, as by adding a thin sheet of patterned polymer or ceramic. The display is then finished in the usual fashion, adding glass substrate 9 having a suitable pattern of anodes 12 and mechanical support frames (not shown), a vacuum sealing structure (not shown) and appropriate conventional electronic components (not shown). Optionally, phosphorus (not shown) can be added to anodes 12).

Yet another variation is to make the cathode conductor 13 from permanent magnet material such as one of the conductive magnetic metals or metal alloys identified hereinabove.

The magnetic components in FIGS. 2–6 can be magnetized in the vertical direction, the horizontal direction, or at any angle therebetween. The non-planar geometry of the magnets in FIGS. 3–6 typically produces a distribution of field directions.

It is to be understood that the above-described embodiments are illustrative of only a few of the many possible specific embodiments which can represent applications of the principles of the invention. Numerous and varied other arrangements can be made by those skilled in the art without departing from the spirit and scope of the invention.

The invention claimed is:

1. In a plasma display device comprising a substrate-supported cathode including an electron-emitting material, a transparent anode spaced from the cathode in a sealed cell, cell walls including walls extending in the direction between said cathode and said anode, an ionizable gas within said cell, and a voltage source connected between said anode and said cathode for exciting emission of electrons from said material to said anode, the improvement wherein at least a portion of a wall extending between said cathode and said anode comprises a permanent magnet for providing a magnetic field transverse to the path of electrons between said electron-emitting material and said anode.

2. The improved device of claim 1 wherein said magnet comprises a screen having an array of openings corresponding to pixels of a display.

3. The improved device of claim 1 wherein said magnet includes electron-emitting material.

4. The improved device of claim 1 wherein said magnet includes diamond electron-emitting material.

5. The improved device of claim 1 wherein said permanent magnet has a magnetic field in excess of 500 gauss.

6. The improved device of claim 1 wherein said permanent magnet has a magnetic field in the range 2000–5000 gauss.

* * * * *